US005575447A

United States Patent [19]

Griffin

[11] Patent Number: 5,575,447

[45] Date of Patent: Nov. 19, 1996

[54] POT HANGER AND HOLDER

[76] Inventor: Frederick M. Griffin, 4131 Paseo de la Tortugas, Torrance, Calif. 90505

[21] Appl. No.: 331,993

[22] Filed: Oct. 31, 1994

[51] Int. Cl.[6] ..... A47F 5/00

[52] U.S. Cl. ..... 248/318; 47/67

[58] Field of Search ..... 248/318, 27.8; 47/41.11, 66, 67; 211/113, 119

[56] References Cited

U.S. PATENT DOCUMENTS

| | | | |
|---|---|---|---|
| 313,667 | 3/1885 | Hesser | 248/318 |
| 770,738 | 9/1904 | Chessman . | |
| 1,095,504 | 5/1914 | Jannoch . | |
| 1,154,627 | 9/1915 | Hall | 47/67 X |
| 1,331,680 | 2/1920 | Sherwood | 248/318 |
| 1,369,965 | 3/1921 | Comstock . | |
| 1,793,072 | 2/1931 | Fanan . | |
| 2,086,355 | 4/1936 | Eansor . | |
| 2,152,018 | 3/1939 | Barnhart | 248/278 X |
| 2,795,454 | 6/1957 | Snook | 248/318 X |
| 3,856,453 | 1/1971 | Hall | 248/318 |
| 4,691,473 | 9/1987 | Ragen | 47/67 |

FOREIGN PATENT DOCUMENTS

| | | | |
|---|---|---|---|
| 5603 | 1/1927 | Australia | 47/67 |
| 607482 | 7/1926 | France | 47/67 |
| 375335 | 5/1923 | Germany | 47/67 |

*Primary Examiner*—J. Franklin Foss
*Attorney, Agent, or Firm*—Daniel L. Dawes

[57] ABSTRACT

A multiple strand pot hanger, and in particular, a three-strand pot hanger is comprised of a multiple strand or wire harness coupled to a ring having a plurality of radially extending ears or connection segments coupled to the harness. The ring has an inner diameter which provides an interference fit with the body of the flower pot placed into the pot hanger. The ring may have a permanent nonadjustable inner diameter or may be temporarily and adjustably joined at its opposing ends to accommodate a wide range of pot diameters. In the case of the nonadjustable ring, the opposing ends may be flash welded or connected together by means of a wire wrap. The connection points spaced along the ring and radially extending from it for connection to the wire harness may be comprised of either U-shaped extensions integrally formed as part of the ring, overhand loops, or dihedral radially extending loops in the case where the ring is made from a flat resilient band.

6 Claims, 2 Drawing Sheets

POT HANGER AND HOLDER

BACKGROUND OF THE INVENTION

1. Field of the Invention

The invention relates to the field of apparatus for the display of flower pots, and in particular, to pots suspended by wire hangers which are held without the necessity of cutting or drilling into the pot in order to secure the wire hanger to the pot.

2. Description of the Prior Art

Wire hangers for pots which do not require drilling or cutting into the pot in order to attached the hanger to the pot are well known. One example directed not to a pot, but to a drip catcher for a pot is shown by Jannoeh, *"Drip Catcher Holder for Hanging Baskets,"* U.S. Pat. No. 1,095,504 (1914). The hanging pot or basket used by Jannoeh is integrally provided with drilled tabs or ears into which the wire hanger is inserted and wound. As best shown in FIG. 1, a drip catcher plate 12 is provided beneath a hanging basket 10. Drip catcher 12 has a rim 13 supported by a ring 14, adapted to fit beneath the rim. In FIG. 2, supporting ring 14 is preferably made of wire and is broken at point 15 so that it may be expanded or contracted to fit drip catchers of varying diameters.

In FIG. 5, ring 14 provides three offsets 16, forming loops which project outwardly and diagonally from the ring. Vertical support members 20 engage the offset loop 16 and provide the support for ring 14. FIG. 2 shows a small piece of tubing 30 in which broken ends of a circular ring 15 are inserted to complete the ring and allow for fine tuning and adjustments in its circumference. Note that the supporting members 20 are secured to the basket 10 as opposed to the hanging wires themselves.

Chessman, *"Adjustable Pot Hanger and Plant Lifter,"* U.S. Pat. No. 770,738 (1904), describes an adjustable pot hanger shown in FIGS. 1 and 2 comprised of three suspension wires B, C and D, formed with hooks b, c and d on their corresponding ends. The hooks b, c and d engage a corrugated circular support wire A which is wrapped underneath circumference of rim 1' of flower pot 1. The circular corrugated support wire A to which the hanging support hook b, c and d are engaged is a length of corrugated wire which has hooks a and a' oppositely disposed on each end of the body A and integral to the body A as shown in FIG. 2. Hooks a and a' may be interlocked with each other so that body A is formed in its largest dimension. By disengaging hooks a and a', the ends of body A may be overlapped to form a circle of appropriate size at which points hooks a and a' are then engaged against the corrugated body A as best shown in FIG. 2. Hooks a and a' are held in engagement by the tension of body A, which results from the weight of flower pot 1. Chessman's system is adjustable to differing sized flower pots, although the adjusting elements are different than those which you proposed.

Comstock, *"Flower Pot Handle,"* U.S. Pat. No. 1,369,965 (1921), shows in FIG. 1 a flower pot handle utilizing two support arms 16 that extend downwards toward the sides of flower pot 10 at the end of which arm 16 are hooks 17 which engage a flared ring 11 at crimp points 12. Flared ring 11 is wrapped around the circumference of flower pot 10 below the rim of the flower pot. Two diametrically opposed crimp points 12 and flared ring 11 are utilized along circumference of flower pot 10.

Fanan, *"Flower Pot Lifting Ring,"* U.S. Pat. No. 1,793,072 (1931), shows in FIG. 2 a flower pot A supported via an adjustable split ring strap C made of metal or other flexible material. Strap C is wrapped around the circumference of the flower pot such that the ends of the strap overlap, also thereby overlapping the apertures a in the strap. A fastening device b is inserted through a selected aperture a and an underlying overlapped aperture which are then secured thereby defining the circumference of the strap.

Eansor, *"Holder for Containers,"* U.S. Pat. No. 2,086,355 (1937), shows in FIG. 1 an adjustable band 18 used to clamp container 3 to brackets 4 and 5. The means adjustment for band 18 comprises a tab 19 secured to the band and having a button 20 adapted to be inserted into openings 21 to become locked into slots 22.

What is needed is a three-strand wire pot hanger having an adjustable retaining band for providing an interference fit with the body of a flower pot.

BRIEF SUMMARY OF THE INVENTION

The invention is a pot hanger for suspending a pot for display. The pot hanger comprises a multiple strand hanger having a common connection at one end and having its strands splayed at an opposing end. A ring is provided which has a predetermined diameter for providing an interference fit with the pot. A plurality of ears are defined in the periphery of the ring. The splayed ends of the multiple strand hanger are coupled to the ears. As a result, the pot hanger suspends the pot without the necessity of drilling or connecting in any manner with the pot other than by means of the interference fit of the body of the pot with the Ring. The pot is suspended without any dependence on the thickness of the pot walls.

The plurality of ears equal in number the number of strands of the multiple strand hanger. The number of stands of the multiple strand hanger are three or more and the number of ears are three or more. In the preferred embodiment the number of strands of the multiple strand hanger are no more than three and the number of ears are no more than three.

In one embodiment the ring is comprised of rigid metal and the ears form substantially U-shaped outwardly extending bends defined in the metal ring. The ring is comprised of an elongated member having two ends which are permanently joined. In one embodiment the two ends are joined by welding. In another embodiment the two ends are joined by bending.

In still another embodiment the ring is comprised of rigid metal and the ears are formed by overhand loops bent into the metal.

In yet another embodiment the ring is comprised of resilient, flexible material formed into an elongated member having two ends. The ends of the elongated member are selectively and temporarily joined to provide an adjustable diameter of the ring. The resilient material from which the ring is made is a metallic band, and the ears are formed as U-shaped dihedral bends extending radially outward on the ring. One end of the metal band is provided with a hook and the other end of the metal band is provided with a plurality of holes defined therethrough for receiving the hook.

More specifically then the invention is characterized as a three stranded pot hanger for use with a pot comprising a three strand wire harness comprised of multiple wires which are commonly joined together at a top end and are separated at an opposing bottom end. A ring having a plurality of radially projecting connectors integrally formed as part of the ring are coupled with the wire harness. The ring provides an interference fit with the pot. As a result, the pot is securely held without requiring permanent attachment to the pot or adjustment for wall width of the pot.

The invention may be better visualized by now turning to the following drawings wherein like elements are referenced by like elements.

The invention and its various embodiments may now be understood by turning to the following detailed description.

DETAILED DESCRIPTION OF THE PREFERRED EMBODIMENTS

A multiple strand pot hanger, and in particular, a three-strand pot hanger is comprised of a multiple strand or wire harness coupled to a ring having a plurality of radially extending ears or connection segments coupled to the harness. The ring has an inner diameter which provides an interference fit with the body of the flower pot placed into the pot hanger. The ring may have a permanent nonadjustable inner diameter or may be temporarily and adjustably joined at its opposing ends to accommodate a wide range of pot diameters. In the case of the nonadjustable ring, the opposing ends may be flash welded or connected together by means of a wire wrap. The connection points spaced along the ring and radially extending from it for connection to the wire harness may be comprised of either U-shaped extensions integrally formed as part of the ring, overhand loops, or dihedral radially extending loops in the case where the ring is made from a flat resilient band.

Figure 1:
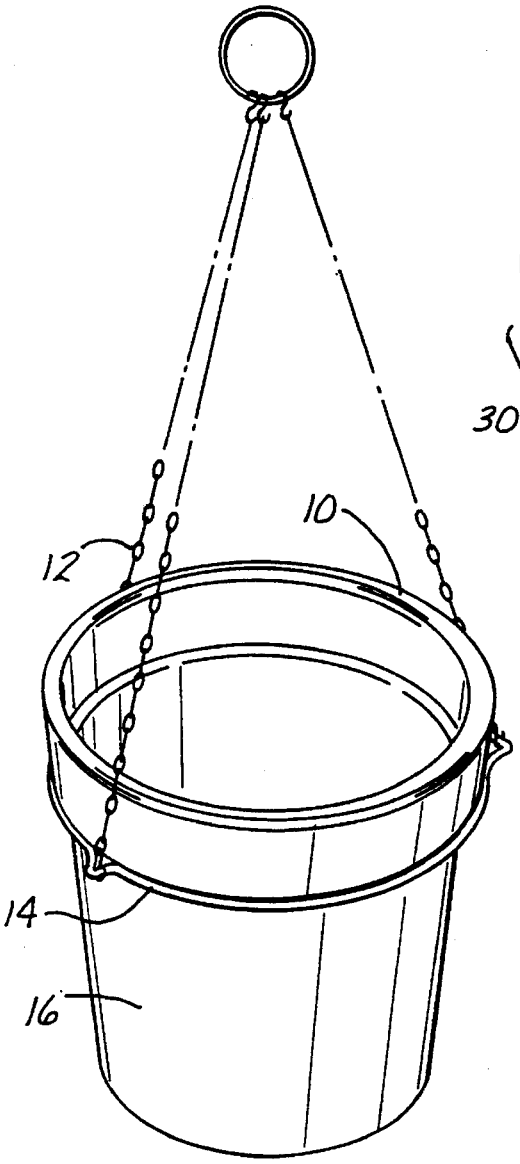
FIG. 1 a simplified perspective view of a first embodiment of the invention a showing pot held by the hanger and pot holder.

Shown in the attached sketch in FIG. 1 is a conventional clay flower pot 10, hung by means of a conventional three-wire strand hanger 12. Hanger 12 is coupled to a ring 14. The three strands of hanger 12 are joined together at their opposing end by any means known in the art to provide a single top attachment point for hanger 12. In the case of a conical flower pot, the size and conical shape of flower pot 16 causes flower pot 10 to be seized by ring 14 even on its conical surface space apart and below peripheral lip 22, or against the bottom surface of lip 22 in the event that the inner diameter of ring 14 exceeds the maximum outer diameter of the conical portion of the clay pot. Hanger 12 is coupled to crimped ears 20 by means of wire wrapping, clips, toggles, or any type of fastener or configuration capable of connecting the wire strands of hanger 12 to ring 14.

Figure 2:
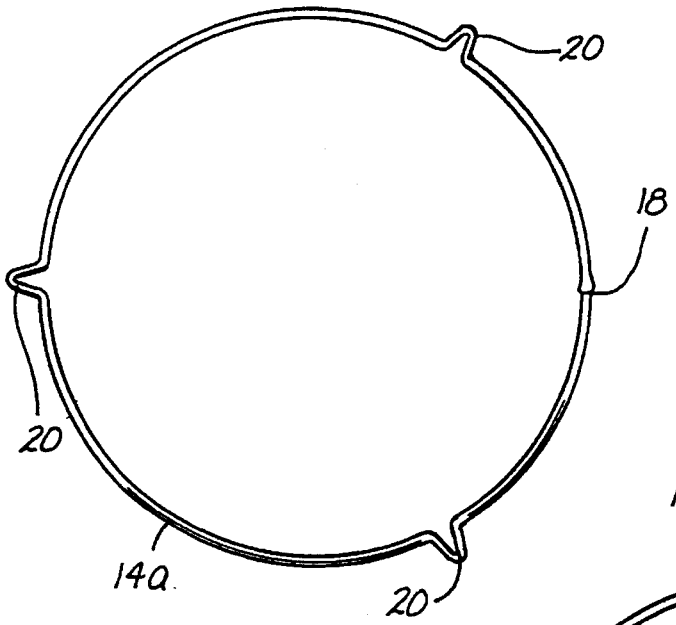
FIG. 2 is a top plan view of the ring used in the embodiment of FIG. 1.

FIG. 2 is a plan view of the embodiment of ring 14 shown in FIG. 1 referenced in FIG. 2 by numeral 14*a*. FIG. 2 is comprised of a single piece wire which is flash welded at junction 18 and includes three equally spaced crimped ears 20, which preferably extend out beyond the overhanging lower edge of the peripheral lip 22 of clay pot 16 to allow a noninterference coupling between the wire strands of hanger 12 and ears 20. In the preferred embodiment, ring 14*a* is made of round wire of common steel with an approximate diameter of 0.125 inch. Other materials and diameters with appropriate stiffness and rigidity could also be substituted. The only requirement is that ring 14*a* be sufficiently rigid as to hold the expected weight of flower pot 10 and its contents when wet without deforming or buckling to the point where retention of pot 10 by hanger 12 becomes unsecured.

Figure 3:
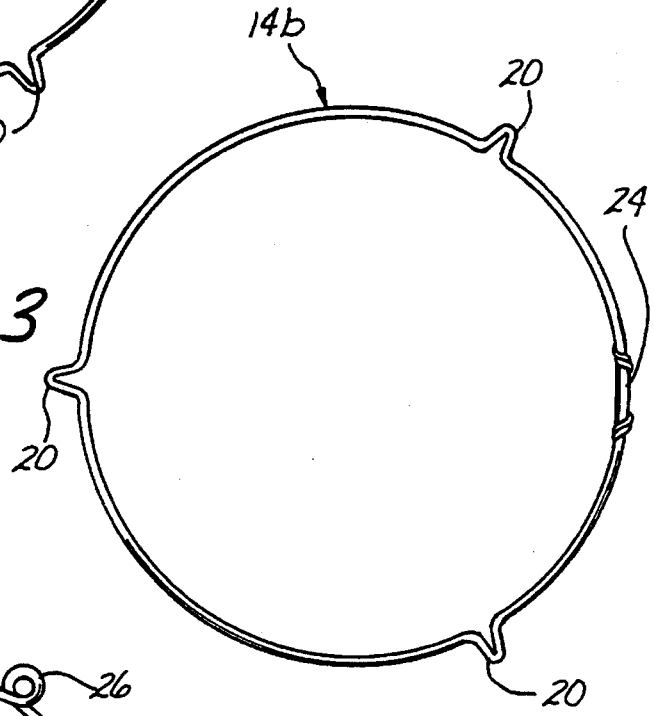
FIG. 3 is a plan view of a second embodiment of the ring shown in FIG. 2.
Figure 4:
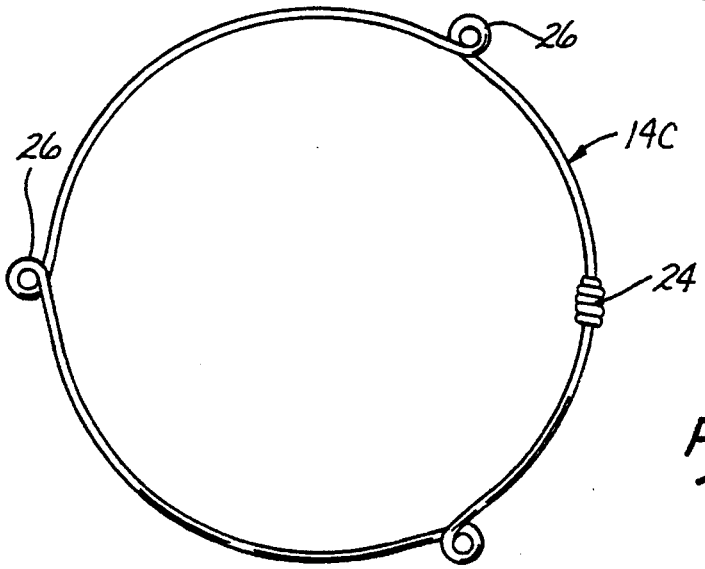
FIG. 4 is a plan view of a third embodiment of the ring shown in FIGS. 2 and 3.

FIG. 3 is a plan view of another embodiment of ring 14, showing a ring referenced by reference numeral 14*b*. The embodiment of FIG. 3 differs from the embodiment of FIG. 2 in that flash weld 18 is replaced by a bailing wire, twisted coupling 24. Any type of wire twister coupling may be used, although what is shown and preferred in the embodiment of FIG. 3 is a wire coupling similar to that used for bailing hay, namely two wraps of each wire end about the opposing standing part of the opposing end, compressed to lie within a generally smooth cylindrical envelope.

A third embodiment of ring 14, here labelled with reference numeral 14*c* includes the bailing wire wrap 24 in place of weld 18 of the embodiment of FIG. 2, but replaces crimped ears 20 with looped ears 26. Again, the rigidity of the material from which ring 14*b* is made is such that looped ears 26 do not substantially deform or unloop under the full loaded weight of pot 10.

Figure 5:
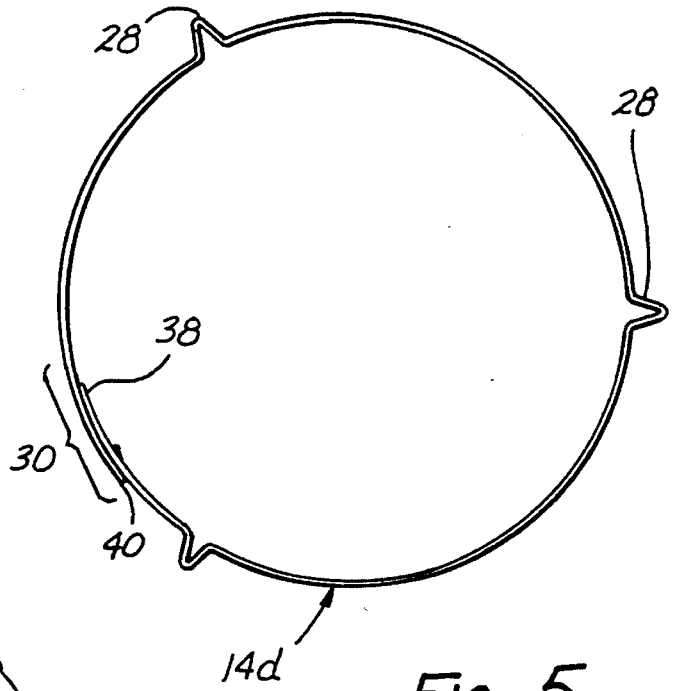
FIG. 5 is a plan view of a fourth embodiment of the ring shown in FIGS. 2–4.
Figure 6:
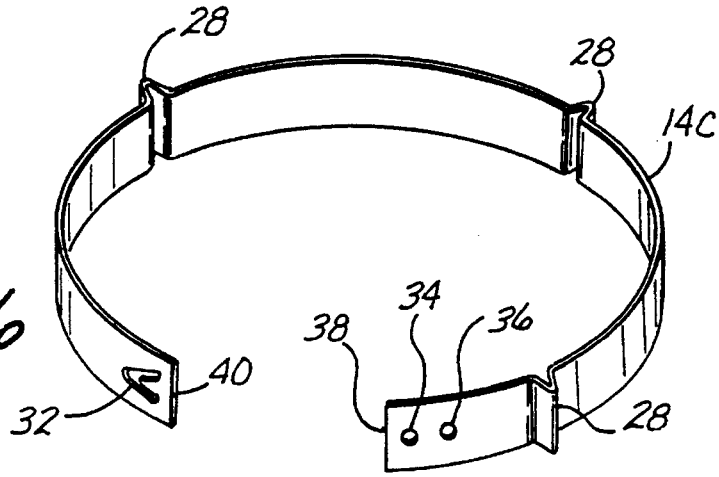
FIG. 6 is perspective view of the embodiment of the ring shown in FIG. 5, shown as opened out, to illustrate the latching mechanism.

FIG. 5 shows a fourth embodiment for ring 14, here referenced by reference numeral 14*d*. Ring 14*d* of FIG. 5 is comprised of a thin flexible metal band of approximately 0.025 inch in thickness, with a width of approximately one-half inch and a length chosen according to the circumference of pot 10 to which ring 14*d* is to be fitted. In this case, dihedral crimps 28 are formed in ring 14*d* in lieu of either loops 20 and 26 in the prior embodiments. The band or ring 14*d* is adjustably joined in section 30 of ring 14*d* by means of the selective disposition of a punched out hook 32 disposed through one or more corresponding holes 34 or 36 according to the size of the pot. Band 14*d* is made of resilient material, such as spring metal, so that the resiliency serves to lock hook 32 into the selected holes. As better shown in the perspective view of FIG. 6, ring 14*d* has a die punched hook 32 or similar fastener defined in or near one end 40, while at the opposing end 38 of ring 14*d*, one or more holes 34 and 36 are punched into and through which hook 32 will be disposed to adjustably accommodate the size of the flower pot to which it is attached. In the preferred embodiment, hook 32 extends into the interior of ring 14*d* so that end 40 is placed in overlapping relationship with end 38 when hook 32 is connected through holes 34 and 36. The natural resiliency of ring 14 then tends to draw hook 32 against the inner surface of the ring in the proximity of band 38, thereby serving to self-lock hook 32 into holes 34 and 36.

In the illustrated embodiments of FIGS. 1–4, the ears 20 and 26 are equally spaced about the ring, each approximately 120 degrees apart from the next adjacent ear. It will be appreciated in the case of the adjustable band of FIGS. 5 and 6 that ears 28 will not necessarily be equally spaced, particularly as the band is adjusted to different sizes. It is contemplated that in one of the sizes, such as the largest size, ears 28 will be equally spaced, although the reverse could just as easily be true. It is unnecessary for ears, 20, 26 and 28 to be equally spaced since the wire strands of hanger 12 connected to ears 20, 26 and 28, whether equally spaced or not, lie at an equal distance from the common top connection of three-strand hanger 12 and will necessarily lie in a common plane thereby holding flower pot 10 level. All that is required is that the relative spacing of ears 20, 26 and 28 not be so closely positioned in one segment of the ring as to result in an unbalanced weight on the wire strands which might tend to cause the ring to be easily upset.

In any case, at least two of ears 28 can, by adjustment or otherwise, be quite closely spaced as long as the third one is on the opposing side of the ring without substantially compromising the stability of hanger 12. The stability allows for a substantial range of adjustability so that a single hanger can accommodate a wide range of pot sizes.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition structure, material or acts beyond the scope of the commonly defined meanings. The definitions of the words or elements of the following claims are, therefore, defined in this specification to include not only the combination of elements which are literally set forth in the specification, but all equivalent structure, material or acts for performing substantially the same function in substantially the same way to obtain substantially the same result.

In addition to the equivalents of the claimed elements, obvious substitutions now or later known to one with ordinary skill in the art are specially defined to be within the scope of each of the defined elements.

The claims are thus to be understood to include what is specifically illustrated and described above, what is conceptionally equivalent, what can be obviously substituted and also what essentially incorporates the essential idea of the invention.

I claim:

1. A pot hanger for suspending a pot for display comprising:

a multiple strand hanger having a common connection at one end and having its strands splayed at an opposing end; and a resilient and flexible ring having a diameter for providing an interference fit with said pot;

a plurality of ears defined in the periphery of said ring, said splayed ends of said multiple strand hanger being coupled to said ears; and a hook and hole fastener integrally formed only from said ring to adjustably and temporarily vary said diameter of said ring but to simultaneously provide nonexpansible restraint to prevent increase of diameter of said ring once adjusted so that said interference fit with said pot is rigid, whereby said pot hanger suspends said pot without the necessity of drilling or connecting in any manner with said pot other than by means of said interference fit with said ring.

2. The pot hanger of claim 1 wherein the number of stands of said multiple strand hanger are three or more and the number of ears are three or more.

3. The pot hanger of claim 2 wherein the number of strands of said multiple strand hanger are no more than three and the number of ears are no more than three.

4. The pot hanger of claim 1 wherein said two part fastener is comprised of one end of said metal band which is provided with a hook and said other end of said metal band which is provided with a plurality of holes defined therethrough for receiving said hook, said hook having a circumferential extent to prevent radial displacement of said ends of said band when said hook is disposed through a selected one of said holes.

5. A three stranded pot hanger for use with a pot comprising:

a three strand wire harness comprised of multiple wires which are commonly joined together at a top end and being separated at an opposing bottom end;

a ring having two separable ends and a plurality of radially projecting connectors integrally formed as part of said ring for coupling with said wire harness, said ring for providing an interference fit with said pot, said ring being formed in a closed loop with an adjustable diameter to fit said pot; and a hook and hole fastener means formed only from and in said ends of said ring for adjustably and temporarily, but securely, varying said diameter of said ring so that said ring is rigidly nonexpandable once formed into a closed loop, whereby said pot is securely held without requiring permanent attachment to said pot or adjustment for wall width of said pot.

6. A pot hanger for suspending a pot for display comprising:

a multiple strand hanger having a common connection at one end and having its strands splayed at an opposing end; and a resilient and flexible wire ring having a diameter for providing an interference fit with said pot;

a plurality of ears integrally formed only from said wire ring, said splayed ends of said multiple strand hanger being coupled to said ears; and a permanent wire wrap fastener integrally formed only from said wire ring to define said diameter of said ring and to simultaneously provide nonexpansible restraint to prevent increase of diameter of said ring so that said interference fit with said pot is rigid, whereby said pot hanger suspends said pot without the necessity of drilling or connecting in any manner with said pot other than by means of said interference fit with said ring.

* * * * *